US007106869B2

(12) United States Patent
Kanda et al.

(10) Patent No.: US 7,106,869 B2
(45) Date of Patent: Sep. 12, 2006

(54) CONDENSER MICROPHONE

(75) Inventors: Hiroshi Kanda, Kanagawa (JP); Shinji Ohyama, Tokyo (JP); Yasuaki Tomiyama, Kanagawa (JP)

(73) Assignee: Sony Corporation, Tokyo (JP)

( * ) Notice: Subject to any disclaimer, the term of this patent is extended or adjusted under 35 U.S.C. 154(b) by 663 days.

(21) Appl. No.: 10/613,666

(22) Filed: Jul. 3, 2003

(65) Prior Publication Data

US 2004/0005070 A1 Jan. 8, 2004

(30) Foreign Application Priority Data

Jul. 4, 2002 (JP) ..... P2002-196343

(51) Int. Cl.
*H04R 25/00* (2006.01)

(52) U.S. Cl. ..... 381/174; 381/369; 381/190; 381/191; 381/355

(58) Field of Classification Search ..... 381/174, 381/190, 191, 178, 355, 361, 369, 113, 114, 381/116, 173, 368; 367/181, 163, 174; 29/25.41, 29/25.42

See application file for complete search history.

(56) References Cited

U.S. PATENT DOCUMENTS 4,156,800 A * 5/1979 Sear et al. ..... 381/114
6,985,597 B1 * 1/2006 Akino ..... 381/174

* cited by examiner

*Primary Examiner*—Curtis Kuntz
*Assistant Examiner*—Tuan Duc Nguyen
(74) *Attorney, Agent, or Firm*—Frommer Lawrence & Haug LLP; William S. Frommer

(57) ABSTRACT

The present invention relates to a condenser microphone whose body can be miniaturized while keeping a property and a sound quality comparable to those of a conventional condenser microphone. The condenser microphone includes a cylindrical body, a plurality of vibration plates which are formed into the shapes of squares and placed in parallel to a body axis line within the body, acoustic holes formed on a body side wall in a direction vertical to the vibration plates and back pole plates which are placed on a side opposite to the acoustic holes with the vibration plate between and face on the respective vibration plates at an interval of a micro gap. A potential of the back pole plate is varied according to a vibration of the vibration plate.

19 Claims, 6 Drawing Sheets

CONDENSER MICROPHONE

RELATED APPLICATION DATA

This application claims priority to Japanese Patent Application JP 2002-196343 filed on Jul. 4, 2002, and the disclosure of that application is incorporated herein by reference to the extent permitted by law.

BACKGROUND OF THE INVENTION

1. Field of the Invention

The present invention relates to a condenser microphone having vibration plates and back pole plates. More particularly, the present invention relates to a condenser microphone in which a miniaturization and a high sound quality are realized so as to be preferably used for the sound collection for the stocking in a musical, a drama or the like.

2. Description of Related Art

Higher sound quality and smaller size are required for condenser microphones used, for example, in the sound collection for stocking of the musical, the drama or the like. Most of those kinds of the condenser microphones usually employ a structure as shown in FIG. 1. That is, a vibration plate 1 is placed in parallel to a sound wave plane. The vibration plate 1 adhered on a circular ring 5 and a ring shape spacer 7 are inserted into a cylindrical body 3. Moreover, a back pole part 9 supported by insulating material is inserted. Then, both ends of the body 3 are closed. Accordingly, the vibration plate 1 and a back pole 9*a* are facing to each other while a predetermined space is maintained.

If the outer diameter of the body 3 becomes minimal, the area of the vibration plate becomes smaller in order to secure the thickness required for the body 3 and the insulator, the space for the adhesive surface to fix the vibration plate 1 and the like. Accordingly, a sensibility is reduced, and an SN ratio is also aggravated.

In view of the above-mentioned circumstances, other types of condenser microphones as shown in FIGS. 2 and 3 are available. The condenser microphone 21 shown in FIG. 2 is configured in such a way that a single rectangular vibration plate 11 adhered on a ring 11*a* is used, and this vibration plate 11 is sandwiched between a front room 13, a spacer 15, a back pole 17*a* and a holder 17, and it is accommodated by a body 19. The condenser microphone 33 shown in FIG. 3 is configured in such a way that two circular vibration plates 23, 23 adhered on rings 23*a*, 23*a* are used, and each of spacers 25, 25 is interposed between each of the two circular vibration plates 23, 23 and each of back poles 27*a*, 27*a*, and a holder 29 is placed oppositely to and sandwiched between the back plates 27*a*, 27*a*, and the holder 29 is accommodated by a body 31.

SUMMARY OF THE INVENTION

However, since the condenser microphone shown in FIG. 2 has only one vibration plate, there is a limitation on securing the vibration plate area. Further, in the case of the condenser microphone shown in FIG. 3, the vibration plate is circular. Thus, as compared with the rectangular type having the side with the same length as the diameter, it has a disadvantage in that the vibration plate area is limited and it is difficult to keep the property if miniaturized.

That is, in the condenser microphone, the area size of the vibration plate affects on the property and the sound quality. Thus, it is required to have a structure in which an electrostatic capacity of about 5 to 10 pF can be obtained without reducing the area size of the vibration plate even if miniaturized.

For example, in the structure shown in FIG. 1, if the dimension of an outer diameter is set to $\phi 5.5$, its electrostatic capacity becomes about 3 pF. With such capacity, the input capacity of FET in an impedance conversion causes the loss of about 3 dB as compared with a case of 10 pF. If the miniaturization is tried under this structure, the electrostatic capacity is further reduced. If the area of the vibration plate is halved, its sensibility is reduced by about 6 dB.

The present invention is conceived in view of the above mentioned circumstances. Accordingly, there has been a need to provide a condenser microphone whose body can be miniaturized while having the property and sound quality comparable to those of a conventional condenser microphone.

According to one embodiment of the present invention, there is provided a condenser microphone (A). The condenser microphone is characterized by including: a cylindrical body; a plurality of vibration plates that are formed into square shapes and placed within the body in parallel to a body axis line; acoustic holes formed on side walls of the body in a direction vertical to the vibration plates; and back pole plates that are placed on a side opposite to the acoustic holes with having the vibration plates in between and face the respective vibration plates with micro gaps in between. A potential of the back pole plate changes in accordance with a vibration of the vibration plate.

In the condenser microphone, the vibration plate is formed into the square shape, and the vibration plate is placed in parallel to the body axis line. Accordingly, the vibration plate can be extended in the axis line direction of the body. Length of the longer sides of the vibration plate along the body axis line and a corner portion area of the vibration plate contribute as the vibration plate. Further, the vibration plate area and the electrostatic capacity are multiplied by the number of the vibration plates. In short, in the limited space of the body, the vibration plates may be densely positioned without any loss. Accordingly, even if the outer dimension of the body is miniaturized, the total area of the vibration plates is not reduced. Moreover, the sound quality that greatly depends on the area of the vibration plate is not deteriorated even after the miniaturization. The further miniaturization may be achieved.

Further, for example, since the two vibration plates are placed, it is possible to employ a dual vibration plate structure (a dual diaphragm structure) in which they are vibrated at an opposite phase with respect to a mechanical vibration. Accordingly, a mechanical noise cancellation function may be obtained for suppressing noises by obtaining the summation signal of the vibration plates vibrated at the opposite phase. Accordingly, it is possible to reduce a handling noise of a microphone cable or the like down to a very low level.

Further, the condenser microphone (A) may be characterized by further including: a contactor having a shape of a letter "U" whose bent portions are connected to respective longitudinal end portions of the back pole plates, the back pole plates being a pair of back pole plates, each of which has a rectangular shape and is positioned in parallel to each other; and a back pole plate case for holding the contactor, the pair of back pole plates and the vibration plates. The back pole plate case includes a polymeric material having a liquid crystal structure.

In this condenser microphone, the back pole plate case for holding the contactor, the pair of back pole plates and the vibration plates is made of the liquid crystal polymer (for example, the liquid crystal polymer) having the liquid crystal structure. Accordingly, the molding property of the back pole plate case becomes better, and the dimensional stability comparable to those of a metal or a ceramic may be obtained. Accordingly, the back pole plate case may be made thinner, thereby making it easier to be miniaturized. Further, the micro gap between the vibration plate and the back pole plate may be positioned with a high accuracy, thereby allowing improvement of the sound quality. Still further, since the polymeric material having the liquid crystal structure has a large inner loss, a damping property may be increased, and may also improve the sound quality.

Still further, the condenser microphone (A) may be characterized by further including: a contactor having a shape of a letter "U" whose bent portions are connected to respective longitudinal end portions of the back pole plates, the back pole plates being a pair of back pole plates, each of which has a rectangular shape and is positioned in parallel to each other; and a back pole plate case for holding the contactor, the pair of back pole plates and the vibration plates. The back pole plate case may be injection-molded after inserting the back pole plates and the contactor.

In the condenser microphone, the back pole plates and the contactor are inserted into a die. Then, melted resin (which is not limited to the liquid crystal polymer) is injected into the die (that is, the insertion-molding is performed). Thus, the pair of back pole plates is integrally fixed by the back pole plate case in such a way that they are connected to the contactor. Accordingly, the plurality of back pole plates are connected and assembled at the same time. Hence, the assembling process is greatly simplified, and the high assembly accuracy may be obtained. In other words, a high microphone sensibility may be obtained.

Further, the condenser microphone (A) may be characterized in that the body has a shape of substantially quadratic prism having the two pairs of parallel body side walls.

In the condenser microphone, the plurality of vibration plates are formed into the squares shapes, and the body for accommodating those vibration plates is formed into the shape of substantially quadratic prism, which does not lead to the creation of useless accommodation space. The vibration plates having the maximum area may be accommodated with the minimum necessary outer shape. In short, the accommodation density may be increased, thereby achieving both the downsizing of the body and the enlargement of the vibration plate area.

BRIEF DESCRIPTION OF THE DRAWINGS

The features and advantages of the present invention will become more apparent in the following description of the presently preferred exemplary embodiments of the invention taken in conjunction with the accompanying drawings, in which.

DESCRIPTION OF THE PREFERRED EMBODIMENTS

The preferred embodiment of a condenser microphone according to the present invention will be described below in detail with reference to the drawings.

Figure 1:
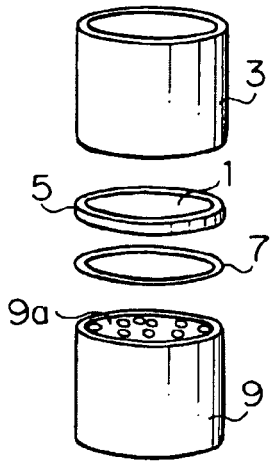
FIG. 1 is a exploded perspective view of a conventional condenser microphone having a single circular vibration plate.
Figure 2:
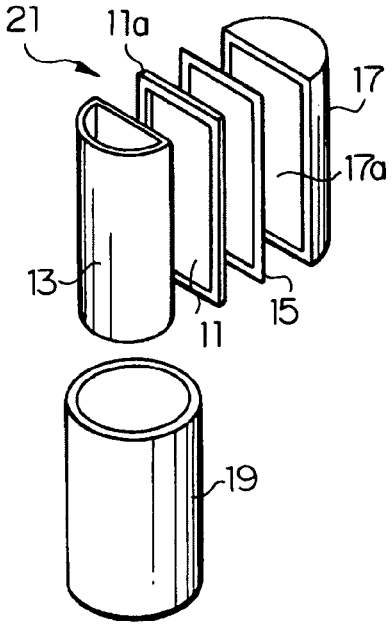
FIG. 2 is a exploded perspective view of a conventional condenser microphone having a single rectangular vibration plate.
Figure 3:
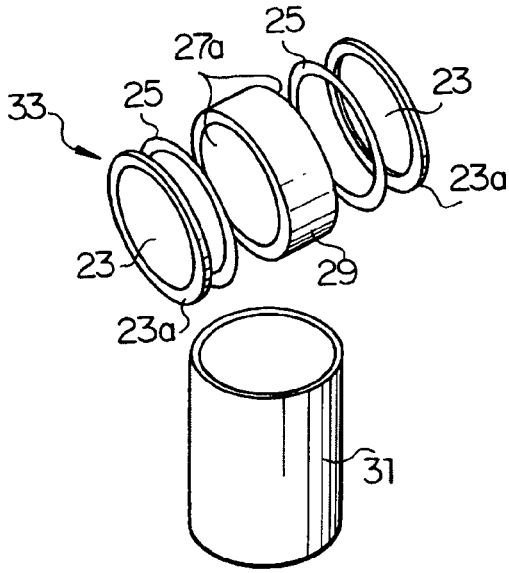
FIG. 3 is a exploded perspective view of a conventional condenser microphone having two circular vibration plates.
Figure 4:
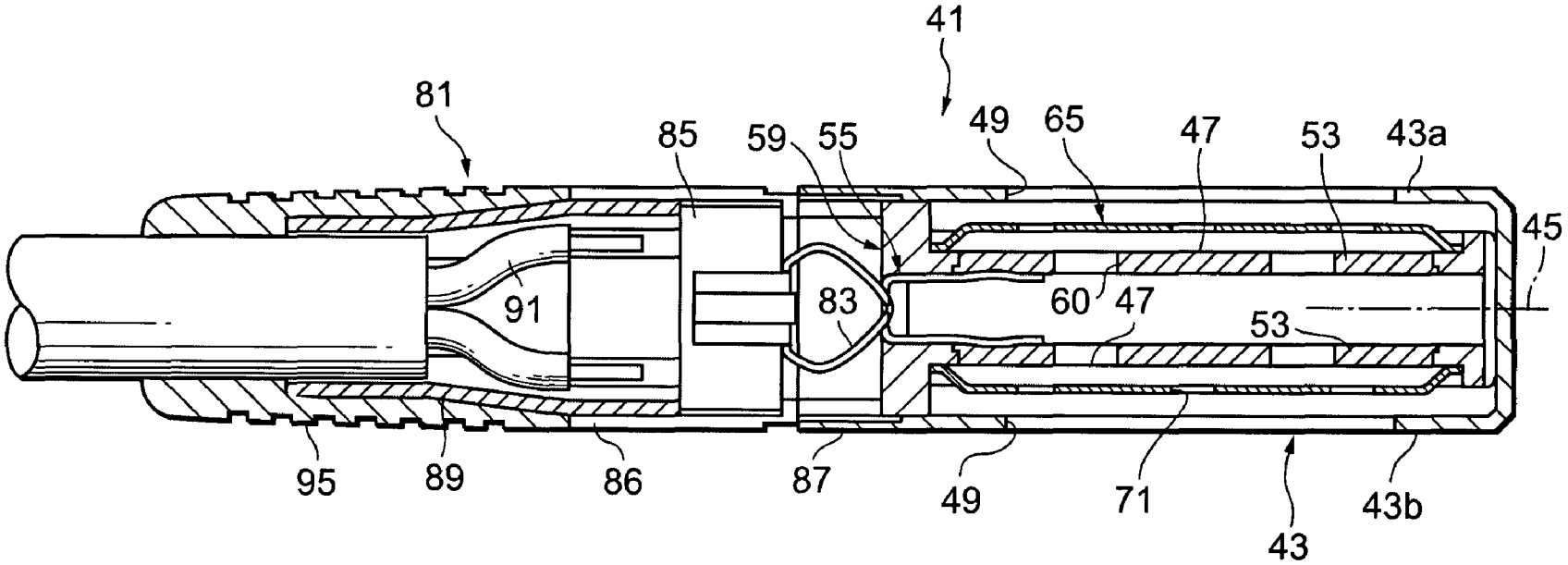
FIG. 4 is a sectional view of a condenser microphone according to the present invention together with an adaptor.
Figure 5:
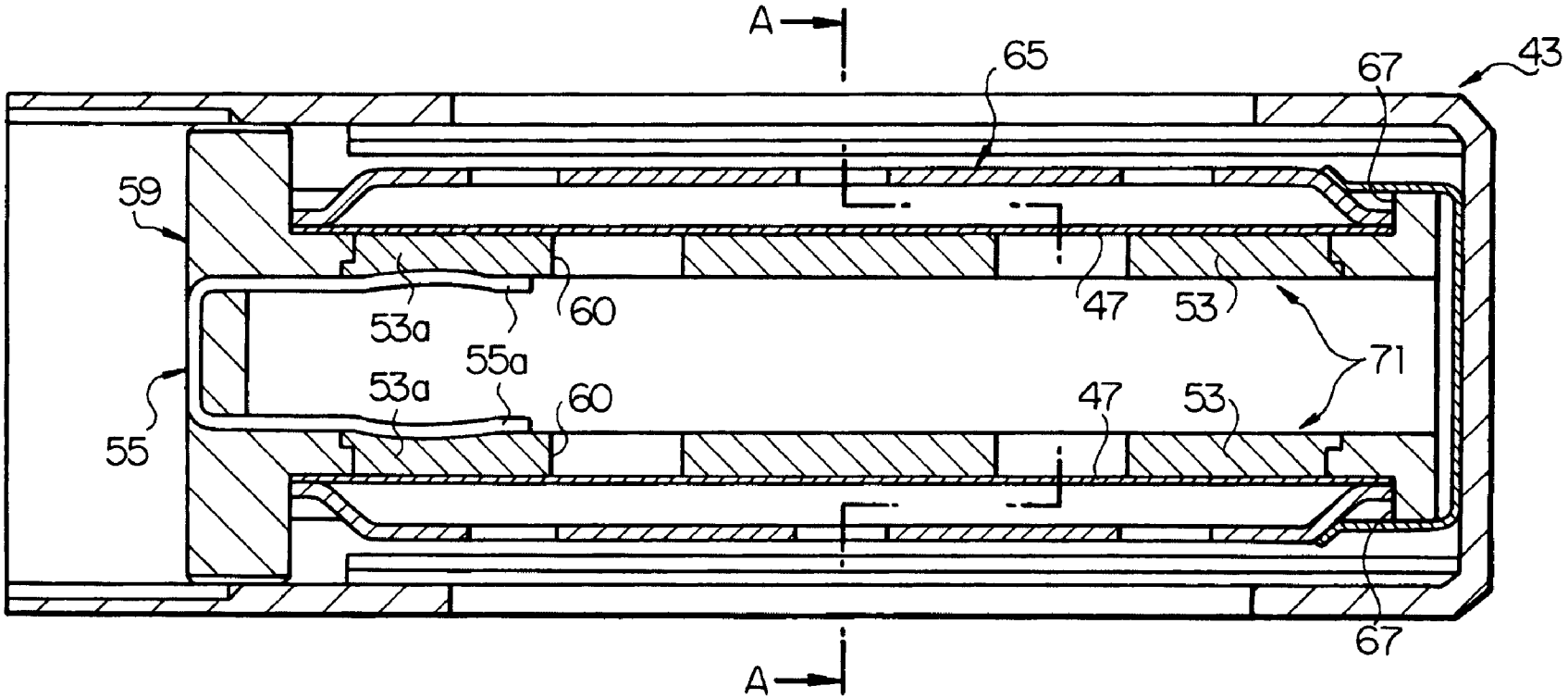
FIG. 5 is a detailed sectional view of the condenser microphone shown in FIG. 4.
Figure 6:
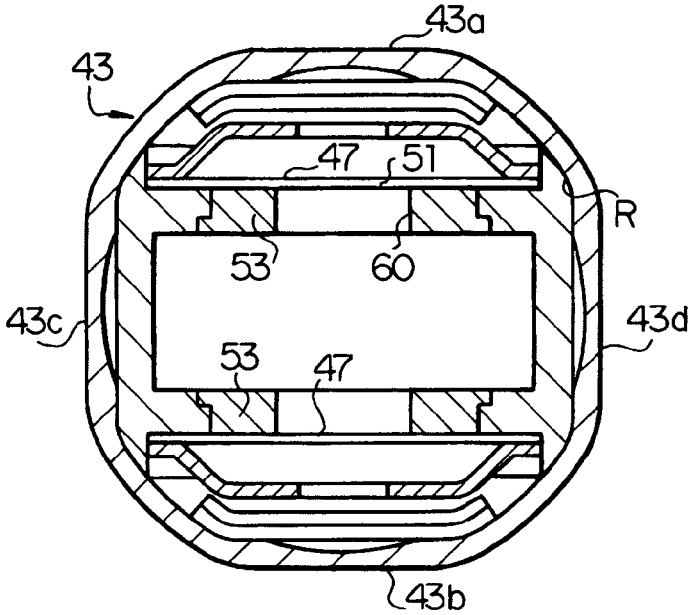
FIG. 6 is an A—A arrow direction view in FIG. 5.
Figure 7:
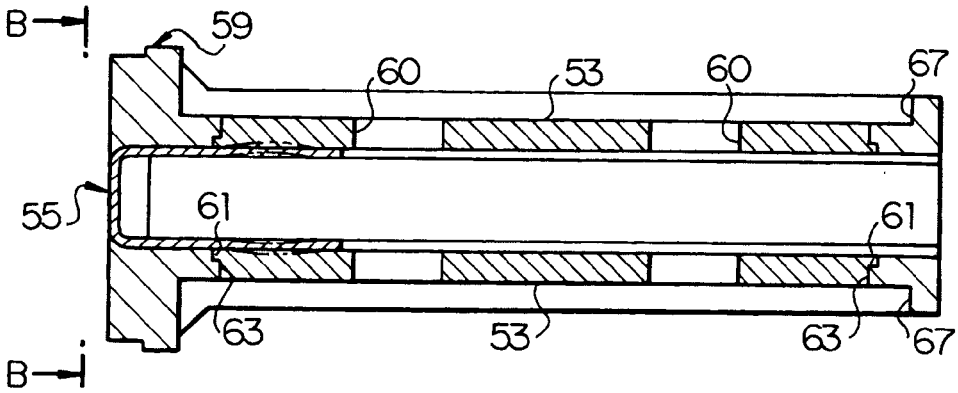
FIG. 7 is a sectional view of a back pole plate case shown in FIG. 5.
Figure 8:
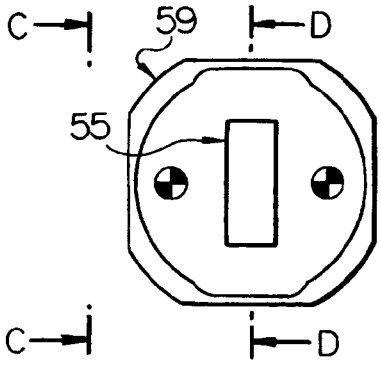
FIG. 8 is a B—B arrow direction view in FIG. 7.
Figure 9:
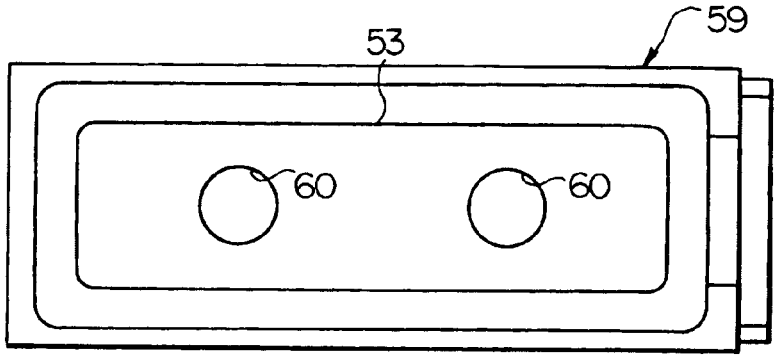
FIG. 9 is a C—C arrow direction view in FIG. 8.
Figure 10:
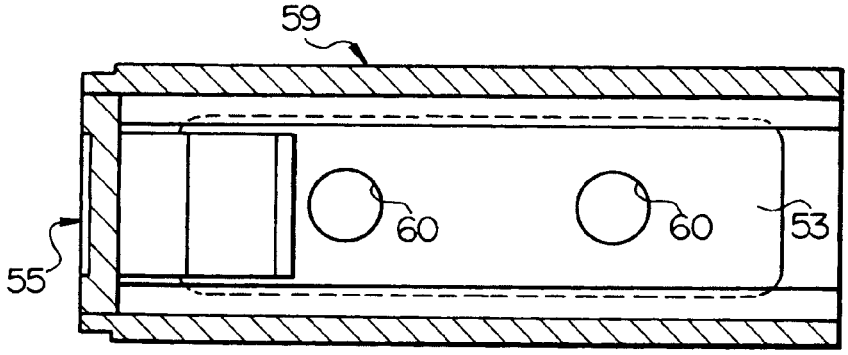
FIG. 10 is a D—D arrow direction view in FIG. 8.
Figure 11:
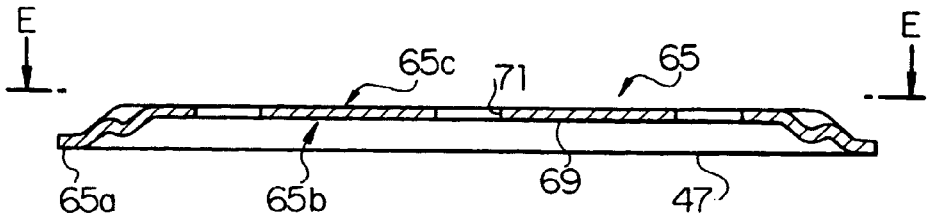
FIG. 11 is a sectional view of a tray shown in FIG. 5.
Figure 12:
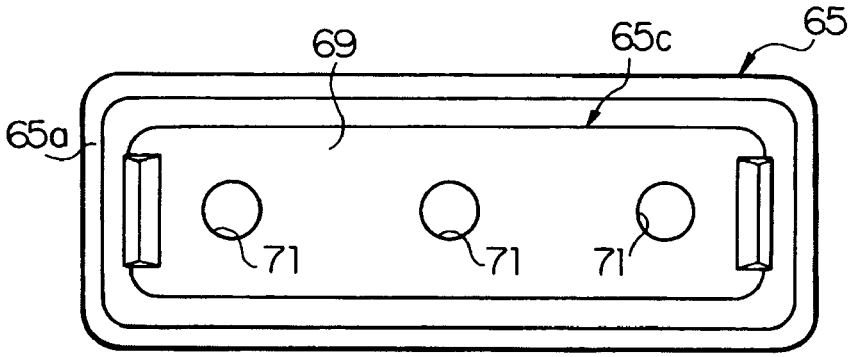
FIG. 12 is an E—E arrow direction view in FIG. 11.
Figure 13:
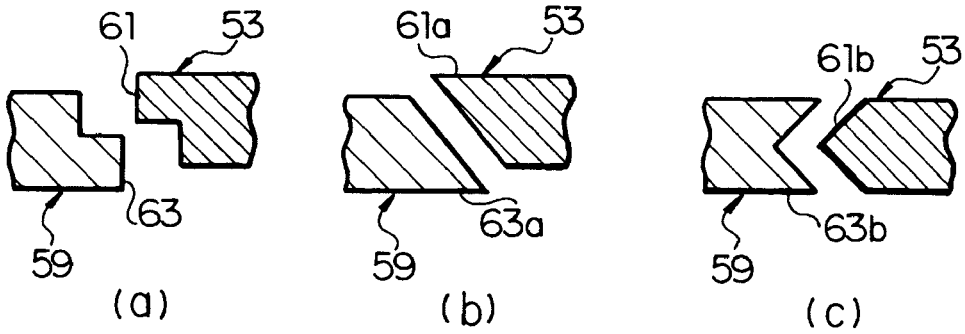
FIGS. 13A, 13B and 13C are explanatory views showing an example of a structure for preventing the back pole plate case and a back pole plate from being fallen-off.

FIG. 4 is a sectional view showing a condenser microphone according to the present invention together with an adaptor. FIG. 5 is a detailed sectional view of the condenser microphone shown in FIG. 4. FIG. 6 is an A—A arrow direction view in FIG. 5. FIG. 7 is a sectional view of a back pole plate case shown in FIG. 5. FIG. 8 is a B—B arrow direction view in FIG. 7. FIG. 9 is a C—C arrow direction view in FIG. 8. FIG. 10 is a D—D arrow direction view in FIG. 8. FIG. 11 is a sectional view of a tray shown in FIG. 5. FIG. 12 is an E—E arrow direction view in FIG. 11. And, FIGS. 13A, 13B and 13C are explanatory views showing an example of a structure for preventing the back pole plate case and a back pole plate from being fallen-off.

For achieving downsizing of the condenser microphone, it is important to have a structure that prevents aggravation of the property and the sound quality due to the miniaturization of components. In other words, the property and the sound quality of the condenser microphone largely depend on an area of a vibration plate. Thus, it is necessary to suppress the reduction in the area of the vibration plate caused by the miniaturization of an outer shape dimension and the decrease in an electrostatic capacity caused by such reduction. For this reason, it is necessary to make the vibration plate area as large as possible. In order to achieve such a goal, a condenser microphone according to an embodiment of the present invention is characterized in that the vibration plate is made into a rectangular shape and a plurality of (two or more) vibration plates are used.

A condenser microphone 41 according to the present embodiment includes: a cylindrical body 43; a pair of vibration plates 47, 47 which are formed into the shapes of squares and placed in parallel to a body axis line 45 within the body; acoustic holes 49 formed on body side walls 43*a*, 43*b* in directions vertical to the vibration plates 47, 47; and back pole plates 53, each being placed on the side opposite to the acoustic holes 49 with the vibration plate 47 in between and facing each of the vibration plates 47, 47 with a micro gap 51 (refer to FIG. 6).

The body 43 is made of insulating material and formed into the shape of the substantially quadratic prism having two pairs of parallel body side walls 43*a*, 43*b*, and 43*c*, 43*d* shown in FIG. 6. Since the body 43 has the shape of the substantially quadratic prism, even when the square vibration plates 47, 47 are accommodated, it does not lead to the creation of useless accommodation space. The vibration plates 47, 47 having the maximum areas may be accommodated in the minimum necessary outer shape. In short, the accommodation density may be increased, thereby achieving both the downsizing of the body 43 and the area enlargement of the vibration plates 47, 47. The reason why the body 43 has the shape of the "substantially" quadratic prism is that four corners may be connected through curve lines R. Alternatively, the body 43 may be formed in a shape of a polygonal pillar, such as a hexagon, an octagon or the like as long as the body 43 has at least a pair of body side walls 43*a*, 43*b*.

The pair of back pole plates 53, 53, each of which is formed into a rectangular shape, placed in parallel to each other and made of metal material (for example, brass), is connected to a contactor 55 that is made of metal material and formed in a shape of the letter "U" as shown in FIG. 5. Longitudinal ends 53*a* of the back pole plates 53 are connected to respective bent portions 55*a*, 55*a* of the contactor 55. Accordingly, the pair of back pole plates 53, 53 is electrically connected through the contactor 55.

On each of the back pole plates 53, 53, an electret material (not shown) for generating an electromotive force is laminated on the surface that faces the vibration plate 47. As a method of driving the condenser microphone, there are two kinds of methods. One of the methods is a film electret method in which a vibration plate on which the electret material is adhered and a back pole plate made of a simple metal are placed to face on each other. The other is a back electret method in which a vibration plate that does not charge electric charges (for example, made of polyester and the like) and a vibration plate on which the electret material is adhered are placed to face on each other, and the electric charges are added to this electret material, thereby generating an initial electromotive force. Among the two methods, the present embodiment employs the latter method where the electret material is adhered on the back pole plates 53, 53. As the electret material, preferably, it is possible to use, for example, fluorine resin such as, poly-tetra-fluoro-ethylene (Teflon (registered trade mark)).

The pair of vibration plates 47, 47 connected through the contactor 55 is integrally molded into a back pole plate case 59 together with the contactor 55. That is, the back pole plate case 59 is formed by a so-called insertion molding for inserting and injection-molding the back pole plates 53, 53 and the contactor 55.

In the insertion molding, the back pole plates 53, 53 and the contactor 55 are inserted into a die. Then, melted resin is injected into the die. Accordingly, as shown in FIG. 7, the pair of back pole plates 53, 53 is integrally fixed by the back pole plate case 59 in the condition that they are connected to the contactor 55. As shown in FIGS. 9, 10, the back pole plate case 59, which is formed into the shape of a square frame, holds the peripheral edge of the back pole plate 53. Accordingly, the plurality of back pole plates 53, 53 are connected and assembled at the same time. Thus, the assembling process is largely simplified, and the high assembly accuracy is obtained.

Further, according to the above-mentioned structure, since the back pole plates 53, 53 on which the electret material is laminated are inserted and laminated, the electret material can be securely and easily fixed to the back pole plates 53, 53. In FIGS. 9, 10, a reference number 60 denotes a sound wave introducing hole formed on the back pole plate 53.

On the back pole plates 53, 53, protrusions 61, 61 shown in FIGS. 7, 13A are protuberantly formed at least on a pair of parallel end planes. On the other hand, fall-off prevention pieces 63, 63 are formed on the back pole plate case 59. The fall-off prevention pieces 63, 63 are placed in contact with those protrusions 61, 61 and thereby regulate the movement of the back pole plates 53, 53 in the direction vertical to the plate surface. According to the above-mentioned structure, the protrusions 61, 61 protuberantly formed on the back pole plates 53, 53 come in contact with the fall-off prevention pieces 63, 63 formed with the molding of the back pole plate case 59 (namely, the protrusion 61 is sandwiched between the contactor 55 and the fall-off prevention piece 63), which results in the restriction on the movement in the direction vertical to the plate surface. Accordingly, the back pole plates 53, 53 and the contactor 55, which were already in the adhered condition by the insertion molding, are further structurally fixed and enable the back pole plates 53, 53 to be further strongly fixed.

Alternatively, the protrusion 61 and the fall-off prevention piece 63 may be respectively formed into the shapes of a protrusion 61*a* and a fall-off prevention piece 63*a* in which both of them are formed into the shapes of sloped planes, as shown in FIG. 13B, or may be respectively formed into the shapes of a tapered protrusion 61*b* and a fall-off prevention piece 63*b* formed into the grooved shape of the letter "V". More specifically, the structure shown in FIG. 13C allows to restrict the movements in both directions vertical to the plate surface.

Here, as the resin to be used in the molding of the back pole plate case 59, for example, a polymeric material having a liquid crystal structure may be preferably used. Such a polymeric material may include, for example, a liquid crystal polymer. The liquid crystal polymer has a high strength, a high elasticity, a heat resistance and a dimensional stability. Also, the material has excellent molding properties (a flowing property and a residence stability). The material has such property that a molecule chain becomes highly oriented and further improves the strength and the coefficient of elasticity as a molded product becomes thinner.

Accordingly, the molding property of the back pole plate case 59 is improved and enables to have the dimensional stability comparable to those of a metal and a ceramic since the back pole plate case is made of the liquid crystal polymer. Accordingly, the back pole plate case 59 may be made thinner, thereby making it easier to downsize. Further, the micro gaps 51 between the vibration plates 47, 47 and the back pole plates 53, 53 may be positioned with a high accuracy to thereby improve the sound quality. Still further, since the polymeric material having the liquid crystal structure has the large inner loss, the damping property may be increased, thereby allowing further improvement of the sound quality.

The back pole plate case 59 is accommodated in the body 43. In this back pole plate case 59, the vibration plates 47, 47 are placed on the portions facing on the acoustic holes 49. Those vibration plates 47 are fixed to a vibration plate attaching unit 67 of the back pole plate case 59 through a tray 65 shown in FIG. 5. As shown in FIGS. 11, 12, the tray 65 is formed into the shape of a square, in which one plane 65*b* other than an peripheral edge 65*a* protrudes over the other plane 65*c* and is depressed therein, and penetration holes 71 are formed on a bottom 69. In the tray 65, the vibration plate 47 is adhered on the peripheral edge 65*a* on the side of the one plane 65*b*.

The tray 65 on which the vibration plate 47 is adhered is fixed to the vibration plate attaching unit 67 at the interval of the micro gap 51, as shown in FIG. 5, in such a way that the vibration plate 47 faces on the back pole plate 53 through a spacer (not shown). The back pole plate case 59 constitutes two acoustic converters 71, 71 since the trays 65, 65 are placed. In the acoustic converters 71, 71, a potential of the back pole plate 53 is changed in according with the vibration of the vibration plate 47, and this potential change is outputted. The outputs from the acoustic converters 71, 71 are extracted through the contactor 55, and connected to an FET (or IC) 85 through a spring contactor 83 of an amplifying unit 81 shown in FIG. 4, thereby generating a microphone output through a load.

The back pole plate case 59 and the tray 65 are fixed as follows. A spacer (not shown) is inserted between the back pole plate case 59 and the tray 65 while having a conductive both-sided tape of several ten μ or a conductive rubber (not shown) in between. After that, while they are clamped with a tool for keeping parallelism and applying a constant pressure, the property is checked. Then, in its condition, adhesive or the like is used to fix them together. Accordingly, an inspection can be carried out before they are completely assembled. Thus, it is possible to stabilize the quality and improve the yield.

A protrusion (not shown) is formed on the tray 65, and the electrical conduction can be established by the insertion into the body 43. The spring contactor 83 of the amplifying unit 81 is attached to an amplifier case 86 through an insulating part. The condenser microphone 41 is fixed to the amplifier case 86 via a lock ring 87. The connection between the amplifier case 86 and the body 43 is carried out by using the lock ring 87 and a wave washer (not shown). A cable chassis 89 is pressed and fitted to the amplifier case 86. In the inner side, the FET 85 to which a microphone cable 91 is soldered is placed. Fixing of these components are carried out by filling the cable chassis 89 with resin.

Holes for the filling procedure are formed on the cable chassis 89. In order to solder the shield of the microphone cable 91 to the cable chassis 89, a slit is formed on the cable chassis 89. Then, the shield is soldered to fixed that portion, or is crimped with a shielding line in between, at the base of the cable chassis 89. Accordingly, the electrical connection and the mechanical strength are secured. After that, a bush 95 formed by molding rubber is adhered.

According to the condenser microphone 41 having the above-mentioned configuration, the vibration plate 47 is formed into the shape of the square, and this vibration plate 47 is placed in parallel to the body axis line 45. Accordingly, the vibration plate 47 can be extended in the axis line direction of the body 43. Length of the longer sides of the vibration plate along the body axis line 45 and a corner portion area of the vibration plate contribute as the vibration plate 47. Further, the vibration plate area and the electrostatic capacity are multiplied by the number of the vibration plates 47. In short, in the limited space of the body, the vibration plates may be densely positioned without any loss. Accordingly, even if the outer dimension of the body 43 is miniaturized, the total area of the vibration plates is not reduced. Moreover, the sound quality that greatly depends on the area of the vibration plate is not deteriorated even after the miniaturization. The further miniaturization may be achieved.

Further, as described in the above embodiment, it is possible to employ a dual vibration plate structure (a dual diaphragm structure) in which they are vibrated at an opposite phase with respect to a mechanical vibration since the two vibration plates 47, 47 are placed. Accordingly, a mechanical noise cancellation function may be obtained for suppressing noises by obtaining the summation signal of the vibration plates 47, 47 vibrated at the opposite phase. Accordingly, it is possible to reduce a handling noise of a microphone cable 91 or the like down to a very low level.

The variation example of the condenser microphone 41 according to the above-mentioned embodiment will be described below.

In the case of the condenser microphone according to the present invention, if the number of the above-mentioned vibration plates 47 is increased to two or more and the back pole plates 53 opposite to them are placed, it is possible to achieve the structure that allows further increase of the vibration plate area and the electrostatic capacity.

Also, in the case of the condenser microphone according to the present invention, if reinforcement is added in order to obtain the mechanical strength in the long side direction of the rectangular vibration plate 47, it is possible to increase the electric field strength between the back poles and thereby possible to achieve the higher output.

Also, in the case of the condenser microphone according to the present invention, the both-sided printed circuit board may be used on the back pole plate 53, and the back pole may be constituted by a copper foil pattern, and FET or IC may be mounted on the rear surface. Thus, the further miniaturization can be realized.

Moreover, in the case of the condenser microphone according to the present invention, the back pole plate 53 may not need to be plate-shaped. For example, it is possible to insert and mold the body having the shape of a quadratic prism made of conductive material.

The condenser microphone according to the present invention is not limited to the film electret method or the back electret method. Even if the present invention is applied to any other method, it can provide functions and effects similar to the above-mentioned embodiments.

Also, in the case of the condenser microphone according to the present invention, the acoustic hole 49 is placed vertically to the vibration plate 47. Alternatively, a sound collecting adaptor may be additionally attached. The attachment of a sound collecting adaptor enables the sounds collection even from a direction along the body axis line 45. Thus, it become possible to obtain the property suitable for an application purpose by controlling a front room effect and changing a high region property on the basis of the shape.

As described above, according to the condenser microphone of the present invention, the body of the condenser microphone may be miniaturized while keeping the property and the sound quality comparable to those of the conventional condenser microphone by including the plurality of vibration plates which are formed into the shape of the squares and placed in parallel to the body axis line. Further, the mechanical noise canceling function peculiar to the dual diaphragm structure may be able to greatly reduce the handling noise of the microphone cable. As a result, it is possible to provide the condenser microphone which has a high sound quality, small in size. The condenser microphone may be suitable for the stocking and for the sound collection in a musical, a drama or the like since the condenser microphone may not be visually outstanding even if it is wared.

While the present invention has been particularly shown and described with reference to preferred embodiments according to the present invention, it will be understood by those skilled in the art that any combinations or sub-combinations of the embodiments and/or other changes in form and details can be made therein without departing from the scope of the invention.

What is claimed is:

1. A condenser microphone comprising:

a cylindrical body;

a plurality of vibration plates that are formed into square shapes and placed within said body in parallel to a body axis line;

acoustic holes formed on side walls of said body in a direction vertical to said vibration plates; and back pole plates that are placed on a side opposite to said acoustic holes with having said vibration plates in between and face said respective vibration plates with micro gaps in between, wherein a potential of said back pole plate changes in accordance with a vibration of said vibration plate.

2. The condenser microphone according to claim 1, further comprising:

a contactor having a shape of a letter "U" whose bent portions are connected to respective longitudinal end portions of said back pole plates, said back pole plates being a pair of back pole plates, each of which has a rectangular shape and is positioned in parallel to each other; and a back pole plate case for holding said contactor, said pair of back pole plates and said vibration plates, wherein said back pole plate case comprises a polymeric material having a liquid crystal structure.

3. The condenser microphone according to claim 1, further comprising:

a contactor having a shape of a letter "U" whose bent portions are connected to respective longitudinal end portions of said back pole plates, said back pole plates being a pair of back pole plates, each of which has a rectangular shape and is positioned in parallel to each other; and a back pole plate case for holding said contactor, said pair of back pole plates and said vibration plates, wherein said back pole plate case is injection-molded after inserting said back pole plates and said contactor.

4. The condenser microphone according to claim 2, wherein said back pole plate case is injection-molded after inserting said back pole plates and said contactor.

5. The condenser microphone according to claim 2, further comprising:

a square tray in which one plane, other than peripheral edge, protrudes over the other plane, thereby forming a depression and a penetration hole on a bottom thereof, wherein said vibration plates are adhered on said peripheral edge on the side of said one plane of said tray, and said vibration plate is held by said back pole plate case via said tray.

6. The condenser microphone according to claim 3, further comprising a square tray in which one plane, other than peripheral edge, protrudes over the other plane, thereby forming a depression and a penetration hole on a bottom thereof, wherein said vibration plates are adhered on said peripheral edge on the side of said one plane of said tray, and said vibration plate is held by said back pole plate case via said tray.

7. The condenser microphone according to claim 4, further comprising a square tray in which one plane, other than peripheral edge, protrudes over the other plane, thereby forming a depression and a penetration hole on a bottom thereof, wherein said vibration plates are adhered on said peripheral edge on the side of said one plane of said tray, and said vibration plate is held by said back pole plate case via said tray.

8. The condenser microphone according to claim 7, wherein an electret material is laminated on said back pole plate.

9. The condenser microphone according to claim 5, wherein an electret material is laminated on said back pole plate.

10. The condenser microphone according to claim 6, wherein an electret material is laminated on said back pole plate.

11. The condenser microphone according to claim 8, wherein:

a protrusion is formed at least on a pair of parallel end planes of said back pole plate; and a fall-off prevention piece formed on said back pole plate case, said fall-off prevention piece being placed in contact with said protrusion, thereby regulating a movement in a direction vertical to a plate surface of said back pole plate.

12. The condenser microphone according to claim 9, wherein a protrusion is formed at least on a pair of parallel end planes of said back pole plate; and a fall-off prevention piece formed on said back pole plate case, said fall-off prevention piece being placed in contact with said protrusion, thereby regulating a movement in a direction vertical to a plate surface of said back pole plate.

13. The condenser microphone according to claim 10, wherein:

a protrusion is formed at least on a pair of parallel end planes of said back pole plate; and a fall-off prevention piece formed on said back pole plate case, said fall-off prevention piece being placed in contact with said protrusion, thereby regulating a movement in a direction vertical to a plate surface of said back pole plate.

14. The condenser microphone according to claim 11, wherein said body has a shape of a substantially quadratic prism having two pairs of parallel body side walls.

15. The condenser microphone according to claim 12, wherein said body has a shape of a substantially quadratic prism having two pairs of parallel body side walls.

16. The condenser microphone according to claim 13, wherein said body has a shape of a substantially quadratic prism having two pairs of parallel body side walls.

17. The condenser microphone according to claim 1, wherein said body has a shape of a substantially quadratic prism having two pairs of parallel body side walls.

18. The condenser microphone according to claim 2, wherein said body has a shape of a substantially quadratic prism having two pairs of parallel body side walls.

19. The condenser microphone according to claim 3, wherein said body has a shape of a substantially quadratic prism having two pairs of parallel body side walls.

* * * * *